US009862464B2

(12) United States Patent
Schmidt

(10) Patent No.: US 9,862,464 B2
(45) Date of Patent: Jan. 9, 2018

(54) MODULAR PONTOON BOAT

(71) Applicant: Chad Schmidt, Louise, TX (US)

(72) Inventor: Chad Schmidt, Louise, TX (US)

( * ) Notice: Subject to any disclaimer, the term of this patent is extended or adjusted under 35 U.S.C. 154(b) by 141 days.

(21) Appl. No.: 14/831,450

(22) Filed: Aug. 20, 2015

(65) Prior Publication Data

US 2016/0052602 A1 Feb. 25, 2016

Related U.S. Application Data

(60) Provisional application No. 62/040,900, filed on Aug. 22, 2014.

(51) Int. Cl.

| | |
|---|---|
| ***B63B 29/02*** | (2006.01) |
| *B63B 1/12* | (2006.01) |
| *B63B 39/06* | (2006.01) |

(52) U.S. Cl.

CPC ..... *B63B 29/02* (2013.01); *B63B 1/125* (2013.01); *B63B 2001/123* (2013.01); *B63B 2001/126* (2013.01); *B63B 2039/067* (2013.01)

(58) Field of Classification Search

CPC ..... B63B 2003/085; B63B 7/04; B63B 1/12; B63B 2001/123

See application file for complete search history.

(56) References Cited

U.S. PATENT DOCUMENTS

| | | | | |
|---|---|---|---|---|
| 2,908,919 A | | 10/1959 | Bicknell et al. | |
| 3,092,854 A | | 6/1963 | Manhart | |
| 3,785,317 A | * | 1/1974 | Currey | B63B 7/082 114/61.25 |
| 4,082,053 A | * | 4/1978 | Woodward | B63H 25/10 114/163 |
| 4,557,210 A | | 12/1985 | Gerwin | |
| 4,562,786 A | | 1/1986 | Pruonto | |

(Continued)

FOREIGN PATENT DOCUMENTS

| | | |
|---|---|---|
| DE | 2411425 A1 | 9/1975 |
| GB | 2387145 B | 5/2004 |
| WO | WO-2010060161 A2 | 6/2010 |

OTHER PUBLICATIONS

International Search Report and Written Opinion for Co-Pending PCT Application No. PCT/US2015/046149 dated Nov. 6, 2015.

(Continued)

*Primary Examiner* — Edwin Swinehart

(74) *Attorney, Agent, or Firm* — Gardere Wynne Sewell LLP

(57) ABSTRACT

According to embodiments disclosed herein, there is provided a modular boat that includes a first pontoon, a second pontoon, an arched coupling member, a deck frame, a deck surface and at least one inflatable seat. The first pontoon has a first longitudinal axis and the second pontoon has a second longitudinal axis. The arched coupling member is removably coupleable to the first pontoon and the second pontoon so that the arched coupling member is perpendicular to the first and second longitudinal axis. The deck frame is removably coupleable to the arched coupling member. The deck surface is removably coupleable to the deck frame and extends in a first plane that is parallel to a second plane that contains the first and second longitudinal axis. The inflatable seat is removably coupleable to the deck surface.

20 Claims, 16 Drawing Sheets

(56) References Cited

U.S. PATENT DOCUMENTS

| | | | | |
|---|---|---|---|---|
| 4,601,667 | A * | 7/1986 | Hull | A47C 4/54 114/345 |
| 4,766,830 | A * | 8/1988 | Kunz | B63B 1/121 114/127 |
| 4,766,918 | A * | 8/1988 | Odekirk | E04H 15/02 114/345 |
| 4,813,366 | A | 3/1989 | Elder | |
| 4,915,047 | A | 4/1990 | Lord et al. | |
| 4,919,632 | A | 4/1990 | Smith et al. | |
| 5,237,954 | A | 8/1993 | Evans | |
| 5,564,955 | A | 10/1996 | Ingraham | |
| 5,575,231 | A | 11/1996 | Metcalf | |
| 5,878,688 | A | 3/1999 | Merrett et al. | |
| 6,148,754 | A * | 11/2000 | Sims, Jr. | B63B 59/02 114/219 |
| 6,526,904 | B2 | 3/2003 | Liston et al. | |
| 6,623,322 | B1 * | 9/2003 | Lesniak | B63B 7/085 114/345 |
| D505,908 | S | 6/2005 | Swenson et al. | |
| 6,929,016 | B2 * | 8/2005 | Lee | E04H 15/20 135/126 |
| D556,668 | S | 12/2007 | Quinn | |
| 8,656,856 | B1 | 2/2014 | Morrow | |
| 2004/0035344 | A1 | 2/2004 | Metzger et al. | |
| 2004/0159275 | A1 | 8/2004 | Broderick et al. | |
| 2007/0131155 | A1 | 6/2007 | Dingel | |
| 2007/0295255 | A1 * | 12/2007 | Stryjewski | B63B 7/04 114/61.22 |

OTHER PUBLICATIONS

Seaeagleboats: How to assemble and use the Sea Eagle SailCat Inflatable Catamaran Sailboat. YouTube. Oct. 16, 2011. [Retrieved Oct. 12, 2015]. Retrieved from the Internet: <URL: https://www.youtube.com/watch?v=_c7nWWCf5mU>. Entire video.

* cited by examiner

MODULAR PONTOON BOAT

CROSS-REFERENCE TO RELATED APPLICATIONS

This application claims priority to U.S. Provisional Patent Application No. 62/040,900, filed Aug. 22, 2014, entitled "Modular Pontoon Boat," which is hereby incorporated herein by reference in its entirety for all purposes.

TECHNICAL FIELD

This disclosure relates to pontoon-style boats, and in particular, to a modular pontoon boat that is easily transported and assembled or disassembled.

BACKGROUND OF THE DISCLOSURE

Boaters use pontoon boats to transport one or more people on a body of water. Pontoon-style boats typically include one or more large pontoons that extend in the principle direction of movement of the boat. Due to the size and shape of typical pontoons, pontoon boats are often difficult to store and transport. For example, boaters usually transport a pontoon boat to and from a body of water on a large trailer coupled to a specialized towing vehicle that has sufficient towing power to pull the trailer and pontoon boat. Once the towing vehicle arrives at the body of water, the boater must find a marina with a suitable unloading area, typically consisting of a large boat ramp that extends into the body of water. Once the boater has located a suitable marina, the driver of the towing vehicle maneuvers the towing vehicle such that a back end of the trailer faces the body of water. The driver then moves the vehicle and trailer in reverse until the boat and the trailer are at least partially submerged in the body of water. The driver then releases the boat from the trailer and a person on the pontoon boat maneuvers the boat away from the trailer. The driver of the towing vehicle must then find a suitable location to store the towing vehicle and the trailer while the pontoon boat is in use.

When use of the boat is terminated, the drive must retrieve the towing vehicle and the maneuver the towing vehicle and trailer to retrieve the boat from the body of water by repeating the steps outlined above in the reverse order. As such, the driver maneuvers the towing vehicle and trailer until the back end of the trailer faces the body of water. The driver then moves the towing vehicle until the trailer is at least partially submersed and the boat can be loaded onto the partially-submerged trailer. The towing vehicle then removes the trailer and pontoon boat from the water and the driver secures the pontoon boat to the trailer for the journey to a boat storage facility. As such, transporting, loading, unloading and storing a pontoon boat is often expensive and time consuming.

In some cases, the pontoon boat is stored at a marina where the boat is docked in the water or raised out of the water. However, this method of storing a pontoon boat is also expensive because pontoon boats require large docks with specialized docking equipment due to the size and shape of the pontoons.

During the off-season, or during other periods of time in which the pontoon boat is not in use, the pontoon boat must be stored. Due to the size and unusual hull shape of typical pontoon boats, boaters often store pontoon boats in outdoor locations, thus exposing the boat to environmental factors which increase the rate at which the boat deteriorates. When indoor storage facilities of sufficient size to hold a pontoon boat are available, those storage facilities tend to be very expensive to lease or own.

What is needed is a pontoon boat that is easy to load, unload, store and transport, while still providing a pontoon-style watercraft for people to enjoy on a body of water.

SUMMARY

In a first aspect, there is provided a modular boat that includes a first pontoon, a second pontoon, an arched coupling member, a deck frame, a deck surface and at least one inflatable seat. The first pontoon has a first longitudinal axis and the second pontoon has a second longitudinal axis. The arched coupling member is removably coupleable to the first pontoon and the second pontoon so that the arched coupling is perpendicular to the first and second longitudinal axis. The deck frame is removably coupleable to the arched coupling member. The deck surface is removably coupleable to the deck frame and extends in a first plane that is parallel to a second plane that contains the first and second longitudinal axis. The inflatable seat is removably coupleable to the deck surface.

In some embodiments, the arched coupling member has a width between a first end and a second end of the arched coupling, and a height between a mid-point of the coupling and the first and second ends of the coupling. In some embodiments, the height of the arched coupling is about half of the width of the coupling.

In other embodiments, the arched coupling includes a motor mount at a midpoint of the arched coupling.

In still other embodiments, the motor mount extends from the midpoint toward a water surface when the boat is on a body of water.

In yet other embodiments, the boat includes a first vertical support member and a second vertical support member. In some embodiments, the first vertical support member is removably coupleable to the first pontoon and the deck frame, and the second vertical support member is removably coupleable to the second pontoon and the deck frame.

In another embodiment, the boat includes an inflatable roof frame that is removably coupleable to one or more of the deck frame and the deck surface.

In still another embodiment, the boat includes a flexible roof material that is removably coupleable to the inflatable roof frame. In some embodiments, the roof material includes one or more retractable window coverings.

In yet another embodiment, the first pontoon includes a first protective plate coupled to a bottom surface of the first pontoon and the second pontoon includes a second protective plate coupled to a bottom surface of the second pontoon.

In some embodiments, the deck surface includes a plurality of rigid, interlocking deck pieces.

In other embodiments, the deck surface includes an inflatable surface.

In a second aspect, there is provided a partially-inflatable, modular pontoon-style boat that includes a first pontoon and a second pontoon; a rigid deck frame that is coupled to the first pontoon and the second pontoon; a deck material that is coupled to the deck frame to provide a deck surface; an inflatable seat that is coupled to the deck surface; an inflatable roof frame that is coupled to the deck surface; and one or more window coverings coupled to the inflatable roof frame.

In some embodiments, the boat includes a first steering rudder coupled to a back end of the first pontoon and a second steering rudder coupled to a back end of the second pontoon.

In other embodiments, a steering cable is operably coupled between a steering device and the first and second steering rudders.

In some embodiments, the first and second pontoons are inflatable.

In another embodiment, the boat includes an inflatable wall that extends along at least part of a perimeter of the deck surface.

In yet another embodiment, the rigid deck frame is coupleable to the first and second pontoons by way of a plurality of arched coupling members.

In still another embodiment, a third pontoon is positioned between the first and second pontoons. In some embodiments, the third pontoon is shorter than the first and second pontoons.

In a third aspect, there is provided a method of assembling a modular pontoon-style boat. The method includes positioning a first pontoon parallel to a second pontoon and coupling a first end of an arched coupling to the first pontoon and a second end of the arched coupling to the second pontoon. The method also includes coupling a deck frame to the arched coupling and coupling a deck material to the deck frame to create a deck surface. The method also includes inflating a wall and coupling the wall to at least part of a perimeter of the deck surface.

In some embodiments, the method includes coupling a motor to a motor mount located at a midpoint of the arched coupling.

In other embodiments, the method includes inflating a roof frame and coupling the roof frame to the deck surface.

Other aspects, features, and advantages will become apparent from the following detailed description when taken in conjunction with the accompanying drawings, which are part of this disclosure and which illustrate, by way of example, principles of the inventions disclosed.

DESCRIPTION OF THE FIGURES

The accompanying drawings facilitate an understanding of the various embodiments. The drawings are not to scale and show only some embodiments. Other embodiments that are not specifically illustrated are within the scope of this disclosure. Embodiments shown in one figure may be combined with embodiments shown in other figures to create further embodiments.

DETAILED DESCRIPTION

Figure 1:
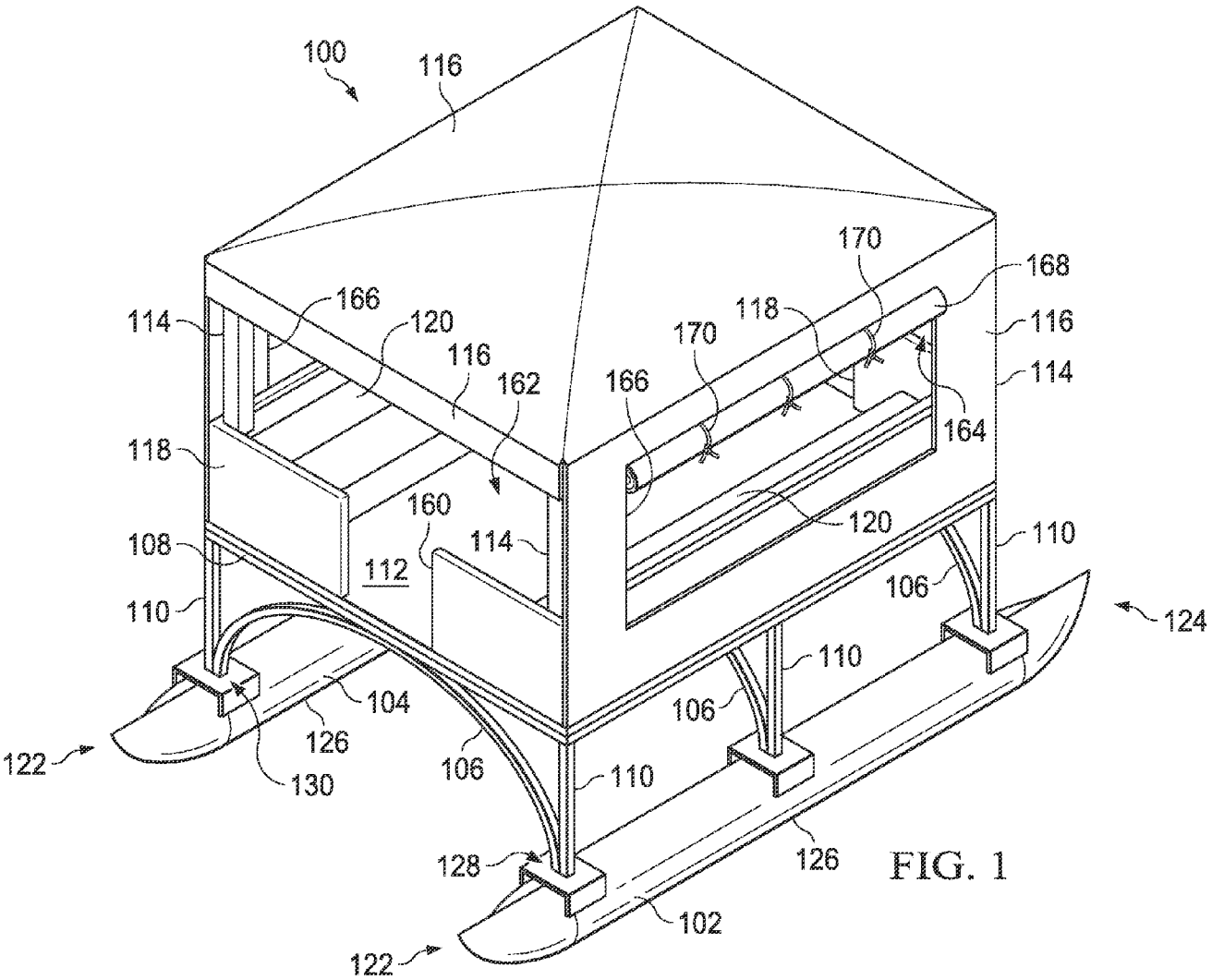
FIG. 1 is a perspective view of an embodiment of a modular pontoon-style boat in accordance with this disclosure.

FIGS. 1-11B illustrate embodiments of a partially-inflatable, modular pontoon-style boat 100 that is easily transported, stored and assembled/disassembled. The modular pontoon boat 100 includes a first pontoon 102 and a second pontoon 104 that are removably coupleable to arched coupling members 106. The arched coupling members 106 removably link the first and second pontoons 104 to a deck frame 108 that is spaced above the first and second pontoons 104, thus providing an area underneath the boat 100 that can be used to store objects or to provide a swimming area for users, as will be described in more detail below. In some embodiments, the boat 100 also includes vertical support members 110 that are removably coupleable to the first and second pontoons 102 and 104 and the deck frame 108 to provide additional structural support to the deck frame. The deck frame 108 is removably coupleable to a deck covering 112 which, as described in more detail below, may include a flexible material, a rigid material, or a combination of rigid inflexible materials on which boat occupants can walk. The pontoon boat 100 also includes an inflatable roof frame 114 and inflatable seats that are removably coupleable to one or more of the deck frame 108 and the deck surface. The roof frame 114 extends above the deck surface and supports a flexible roof material 116 in an elevated position over the deck surface. The pontoon boat 100 also includes an inflatable peripheral wall 118 that is coupleable to one or more of the deck surface and the deck frame 108. In some embodiments, the boat 100 is configured and sized to hold a single person. In other embodiments, the boat 100 is configured and sized to hold more than one person.

As described in more detail below, the above-described components of the boat 100 are modular and can be disassembled to allow for compact storage and transport of the boat 100. For example, in some embodiments the boat 100 is transported to a body of water in a disassembled state and then assembled on-site at the body of water. In some embodiments, the modular components of the boat 100 are made of lightweight materials so that a user can easily launched from the shore into the body of water without the need for a boat ramp. In addition, the light weight, modular components can be stored and transported in the disassembled state without the need for a specialized trailer and towing vehicle. In some embodiments, for example, the pontoon boat 100 can be disassembled and/or deflated to fit within a small storage space, such as the bed of a pickup truck, for storage between uses.

FIG. 1 illustrates an embodiment of the boat 100 in the fully-assembled state. It is to be understood that the boat 100 can be disassembled and that each of the components described herein is removably coupleable to the mating components, thus allowing for disassembly of the components for convenient transportation and storage of the boat 100. In the embodiment illustrated in FIG. 1, the first and second pontoon 102 and 104 each have an elongated shape with a pointed front end 122 and a pointed back end 124. In some embodiments, the front and back ends 122 and 124 of the first and second pontoons 102 and 104 include attachment mechanisms, such as anchor loops or boat 100 hooks (not shown), to secure the pontoon boat 100 to an anchor or other object.

In some embodiments, the first and second pontoons 102 and 104 include a rigid outer surface filled with a buoyant material, such as a buoyant foam. In some embodiments, the pontoons 102 and 104 are made of a metal material, such as stainless steel, while in other embodiments the pontoons 102 and 104 are made of other rigid materials, such as reinforced plastic materials. In other embodiments, the first and second pontoons 102 and 104 include a flexible outer surface and are inflatable.

While the pontoons 102 and 104 illustrated in the embodiment of FIG. 1 are elongated in shape and are slightly longer than the deck frame 108, the first and second pontoons 102 and 104 may have any suitable shape and size. For example, in some embodiments the pontoons 102 and 104 have a length that is slightly shorter than the length of the deck frame 108. In some embodiments, the pontoons 102 and 104 have a flat back end 124 to allow space for one or more motors 134 or rudders 140 (see FIG. 3), as will be described in more detail below. In some embodiments, the pontoons 102 and 104 have a size and shape corresponding to the environment in which a boater will most frequently use the boat 100. For example, if a boater plans to use the boat 100 on smaller lakes and rivers, the user may chose an embodiment of the boat 100 that includes smaller, shorter pontoons 102 and 104. In some embodiments, the pontoons 102 and 104 are sized to fit within a bed of a pickup truck. In some embodiments, the pontoons 102 and 104 are configured as small as possible (while still supporting the weight of users on the boat) so that they are easily transported and stored.

In some embodiments, the pontoons 102 and 104 include one or more reinforcing plates (not shown) located on an interior or exterior surface of the bottom surface 126 of the pontoons 102 and 104. In some embodiments, the reinforcing plates extend substantially the entire distance from the front end 122 to the back end 124 of the pontoons 102 and 104 and protect the bottom surface 126 of the pontoons 102 and 104 while a user loads or transports the boat 100 by dragging the pontoons 102 and 104 on a ground surface. Thus, a user can assemble the pontoon boat 100 on the ground at or near a shoreline of a body of water and then transport the boat 100 to the body of water by dragging the boat 100 without damaging the pontoons 102 and 104.

The pontoons 102 and 104 are removably coupled to the deck frame 108 by one or more arched coupling members 106. The arched coupling members 106 are generally in the form of an arch and include a first end 128 that is removably coupled to the first pontoon 102 and the second end 130 that is removably coupled to the second pontoon 104. In some embodiments, a midpoint of the arched coupling members 106 is removably coupled to the deck frame 108 to secure the first and second pontoons 104 to the deck frame 108. In some embodiments, the arched coupling members 106 are made from one-inch diameter aluminum piping. While three arched coupling members 106 are illustrated in the embodiment of FIG. 1, any number of arched coupling members 106 can be included on the boat 100 to couple the pontoons 102 and 104 to the deck frame 108 in other embodiments.

In some embodiments, the arched coupling members 106 have a height that is approximately half the distance of the width of the arched coupling members 106. In some embodiment, for example, the arched coupling members 106 have a height of about 5 feet and a width of about 10 feet and are coupled to pontoons 102 and 104 that have a length of about 17 feet. In some embodiments, the arched coupling members 106 provide for sufficient space under the deck frame 108 for users to swim, store items, or otherwise use the vacant space. In some embodiments, for example, the arched coupling members are between about 3 and about 8 feet in height and between about 6 and about 18 feet wide so that a typical kayak or canoe can be placed beneath the boat 100 (see, e.g., FIG. 9). In other embodiments, the arched coupling members are between about 5 and about 8 feet in height and between about 10 and about 18 wide so that a watercraft such as a jet ski can be placed beneath the boat 100. In other embodiments, the arched coupling members 106 have other heights and widths and the pontoons 102 and 104 have other lengths and the foregoing dimensions are not intended to limit this disclosure. In other words, this disclosure and the inventions described herein is not limited to particular dimensions and the dimensions above are given only as example embodiments.

In some embodiments, the arched coupling members 106 are a single, unitary piece while in other embodiments the arched coupling members 106 include multiple arched pieces. In some embodiments, the arched coupling members 106 are semi-circular in shape while in other embodiments the arched coupling members 106 have another suitable shape to provide for extra space below the boat 100, such as a semi-elliptical shape or other curved shape.

In some embodiments, the first and second pontoons 104 are also removably secured to the deck frame 108 by vertical support members 110. In some embodiments, the vertical support members 110 are coupleable to the first and second pontoons 102 and 104 at a location adjacent to the connection between the arched coupling members 106 and the pontoons 102 and 104. Thus, in some embodiments a first vertical support member 110 is positioned adjacent to a first end 128 of each arched coupling member 106 and a second vertical support member 110 is positioned adjacent to the second end 130 of each arched coupling member 106, as illustrated in FIG. 1. In some embodiments, the vertical support members 110 are between about 1 and 3 feet long. In other embodiments, the vertical support members 100 are more than about 3 feet long.

Figure 2:
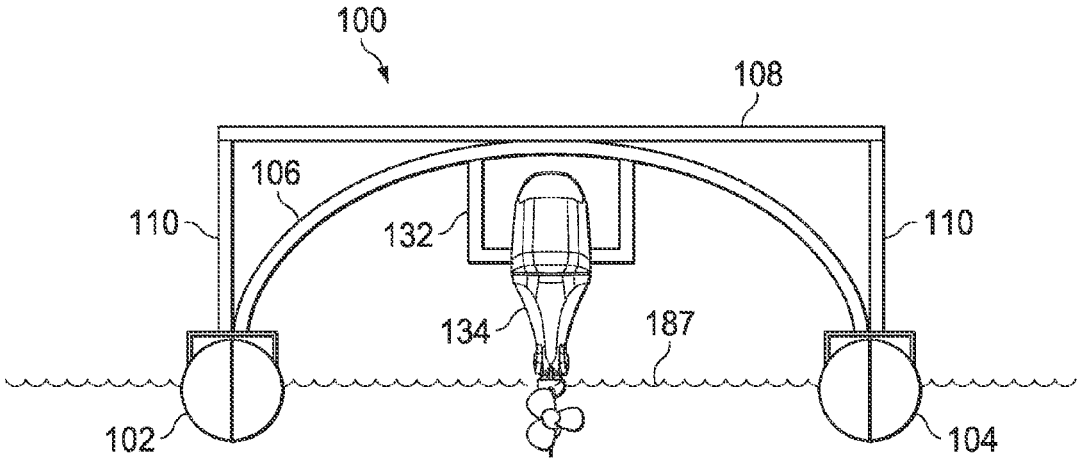
FIG. 2 is a back side view of a lower part of an embodiment of a modular pontoon-style boat showing a motor mount in accordance with this disclosure.

Referring now to FIG. 2, in some embodiments one or more of the arched coupling members 106 includes a motor mount 132 positioned at or near a midpoint of the arched coupling member 106. In some embodiments, the rear-most arched coupling member 106 includes a motor mount 132, as illustrated in FIG. 2. In some embodiments, the motor mount 132 extends away from the deck frame 108 to lower the position of the motor 134 so that the motor 134 contacts the water surface 187. In some embodiments, the motor mount 132 includes a surface to which a motor 134 is coupleable. In some embodiments, for example, the motor mount 132 includes a shelf feature (not shown) to which the motor 134 is mounted.

Any suitable motor 134 can be coupled to the motor mount 132. In some embodiments, the motor 134 is an electric motor 134. In other embodiments, the motor 134 is a gasoline-powered motor 134. In some embodiments, a gas tank (not shown) is also coupled to the motor mount 132. In other embodiments, a gas tank is located in another location on the boat 100, such as a designated area on the deck surface 112.

Figure 3:
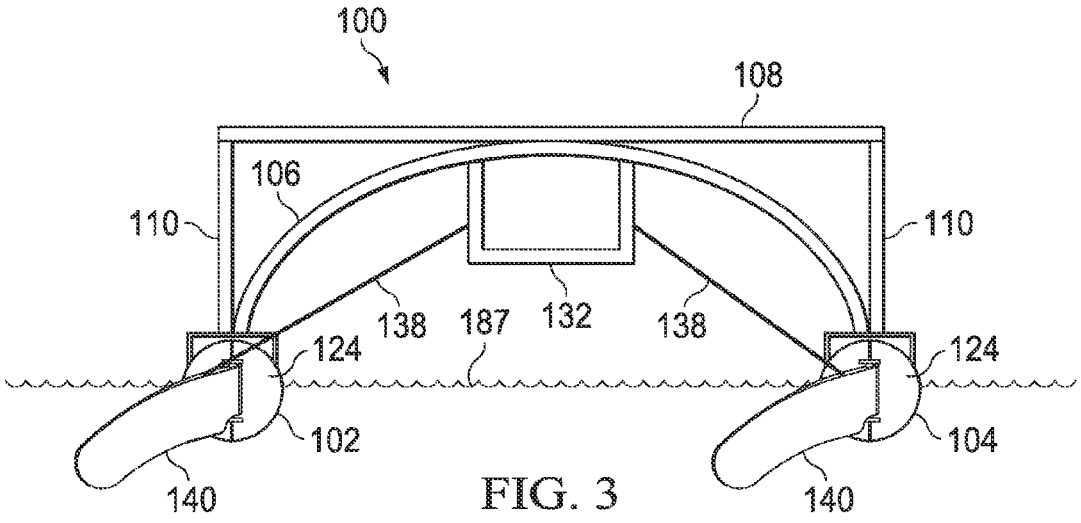
FIG. 3 is a back side view of a lower part of an embodiment of a modular pontoon-style boat showing steering cables in accordance with this disclosure.

Referring now to FIG. 3, in some embodiments one or more steering cables 138 connect the motor mount 132, a steering device (not shown) located on the deck surface 112 and one or more rudders 140. In some embodiments, the steering cables 138 extend from the motor mount 132 to rudders 140 located at a back end 124 of the pontoons 102 and 104 to enable a user to steer the boat 100. A user can steer the boat 100 in any other suitable manner in other embodiments. For example, in some embodiments one or more steering cables 138 couple a steering device on the deck frame 108 to the motor 134 or the motor mount 132 to adjust the angle of the motor 134 in the water, thereby steering the boat 100.

Figure 4:
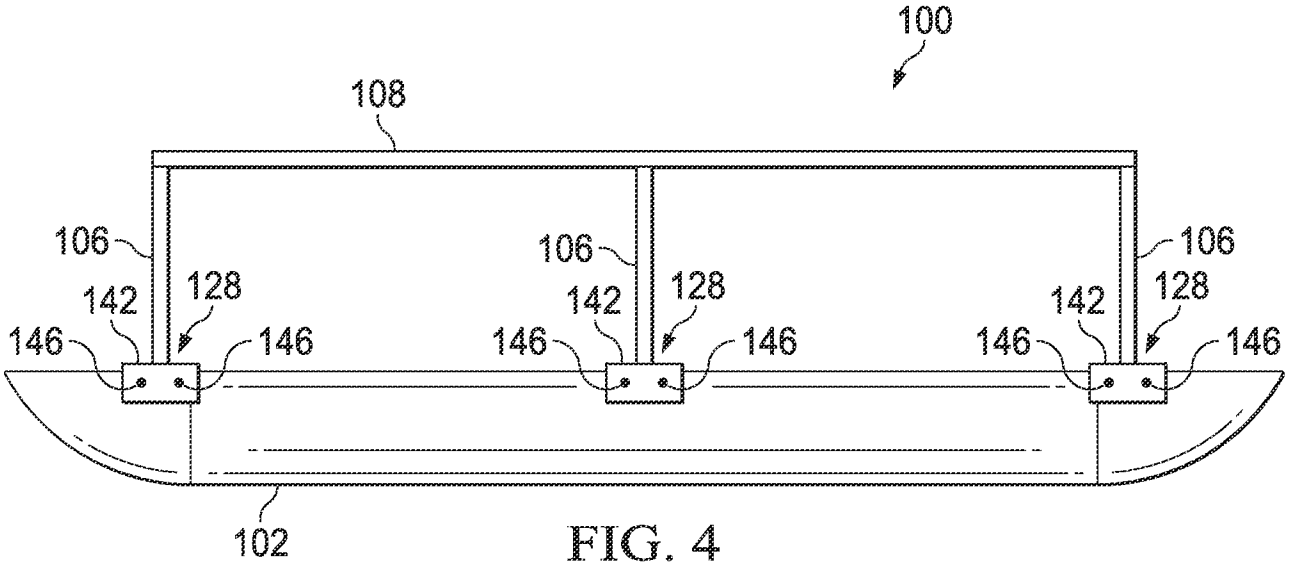
FIG. 4 is a side view of a lower part of an embodiment of a modular pontoon-style boat showing attachment plates of the arched supports in accordance with this disclosure.

Referring now to FIG. 4, in some embodiments the arched coupling members 106 include coupling plates 142 attached to the first end 128 and the second end 130 (the second end 130 of the arched coupling members 106 is obscured from view in FIG. 4) of each arched coupling member 106. In some embodiments, the pontoons 102 and 104 also include corresponding coupling plates (not shown) to allow a user to couple the coupling plates 142 of the arched coupling members 106 to the coupling plates (not shown) of the pontoons 102 and 104. In some embodiments, the coupling plates 142 of the arched coupling members 106 are coupleable to the coupling plates (not shown) of the pontoons 102 and 104 through the use of one or more fastening mechanisms 146, such as, for example, one or more bolts. In some embodiments, the coupling plates 142 are made of 0.25-inch thick metal material.

Figure 5:
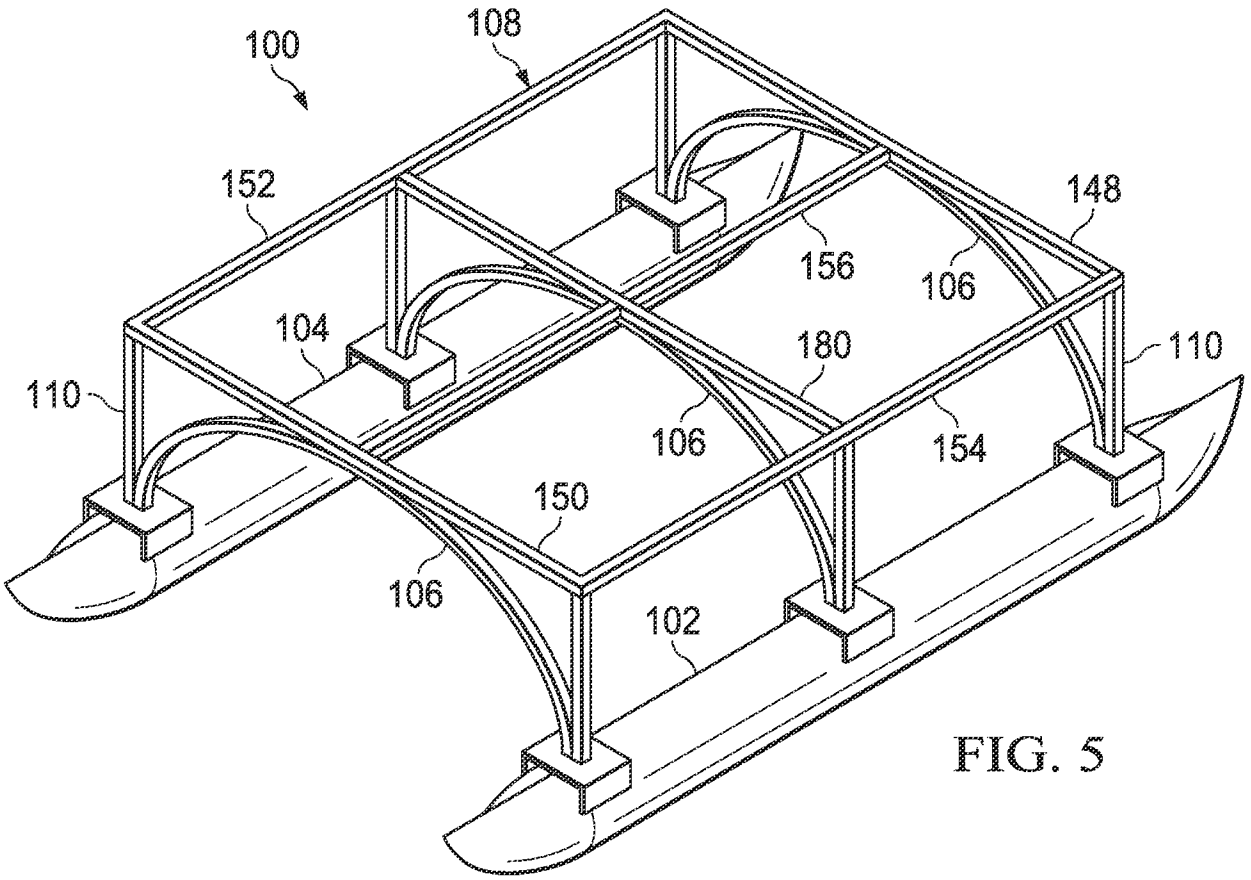
FIG. 5 is a top perspective view of a lower part of an embodiment of a modular pontoon-style boat showing a deck frame coupled to the arched supports in accordance with this disclosure.

Referring now to FIG. 5, the deck frame 108 is shown removably coupled to the arched coupling members 106 and the vertical support members 110. In some embodiments, the deck frame 108 includes a plurality of interlocking members. For example, in some embodiments, the deck frame 108 includes a front member 148 and a rear member 150 that extend the full distance between the first pontoon 102 to the second pontoon 104. In addition, the deck frame 108 includes a first lateral member 152 and a second lateral member 154 that extend from the front member 148 to the rear member 150. In some embodiments, the front member 148, the rear member 150, the first lateral member 152 and the second lateral member 154 are coupled together to form a square or rectangular shape. In other embodiments, the deck frame 108 can be any suitable shape, such as, for example, a round shape or a triangular shape.

The deck frame 108 may also include one or more central lateral members 156 that extend from the front member 148 to the rear member 150. In some embodiments, the deck frame 108 also includes additional support members 180 located above each arched coupling member 106. In the embodiment illustrated in FIG. 5, for example, the deck frame 108 includes one additional support member 180 positioned above a central arched support member 106. In some embodiments, the additional support member 180, the front member 148 and the rear member 150 are removably coupled to the arched coupling members 106, for example, by way of a plate-to-plate connection such as that disclosed above.

Figure 6:
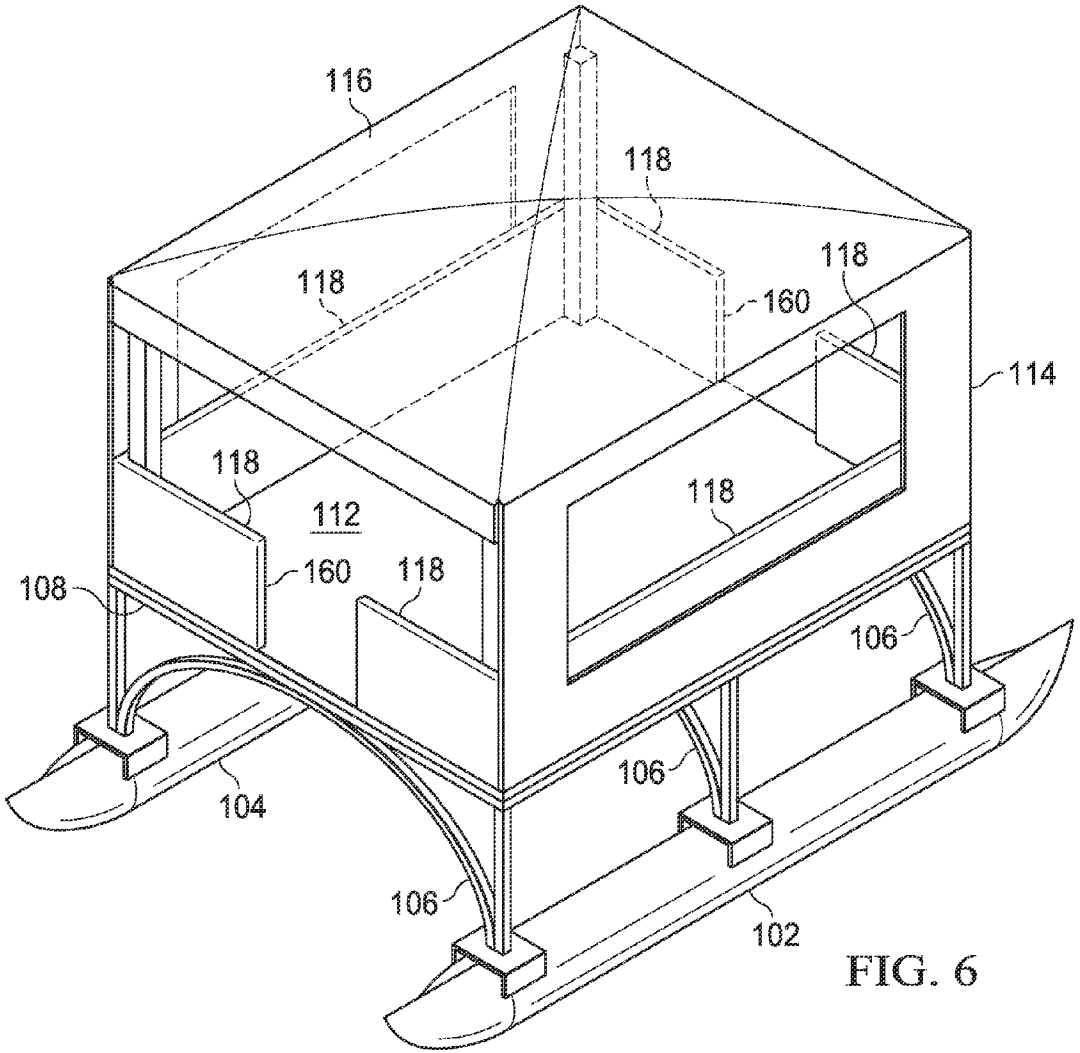
FIG. 6 is a perspective view of an embodiment of a modular pontoon-style boat showing side walls coupled to the deck surface in accordance with this disclosure.

Referring now to FIG. 6, in some embodiments a deck surface 112 is coupleable to the deck frame 108. In some embodiments, the deck surface 112 is a flexible material that is secured to the deck frame 108. In some embodiments, the deck surface 112 is a single piece of material while in other embodiments the deck surface 112 is made of a plurality of pieces of material. In some embodiments, the deck surface 112 is a flexible trampoline material which, in some embodiments, also includes a cable material that is woven across the width of the trampoline material. In other embodiments, the deck surface 112 is rigid and includes a plurality of rigid members that are interlockable to cover the deck frame 108. In some embodiments, the rigid members are made of a hard plastic material that couples to adjacent pieces of material with a tongue and groove feature.

In some embodiments, the boat 100 includes one or more inflatable walls 118 positioned along a peripheral edge of the deck surface 112. In some embodiments, the walls 118 are coupled to one or more of the deck surface 112 and the deck frame 108. In some embodiments, the walls 118 are inflatable such that the walls 118 can be deflated and stored in a compact configuration when the boat 100 is not in use. The inflatable walls 118 can be made of any suitable material that is substantially air-impermeable and can be formed into an inflatable shape, such as, for example, PVC-coated vinyl. In some embodiments, the walls 118 extend around the entire peripheral edge of the deck surface 112 while in other embodiments the walls 118 extend around only part of the peripheral edge of the deck surface 112, as shown in the embodiment illustrated in FIG. 6. In some embodiments, the walls 118 include one or more doors and/or doorways 160 to allow entry and exit from the deck surface 112 through the wall 118.

Figure 7:
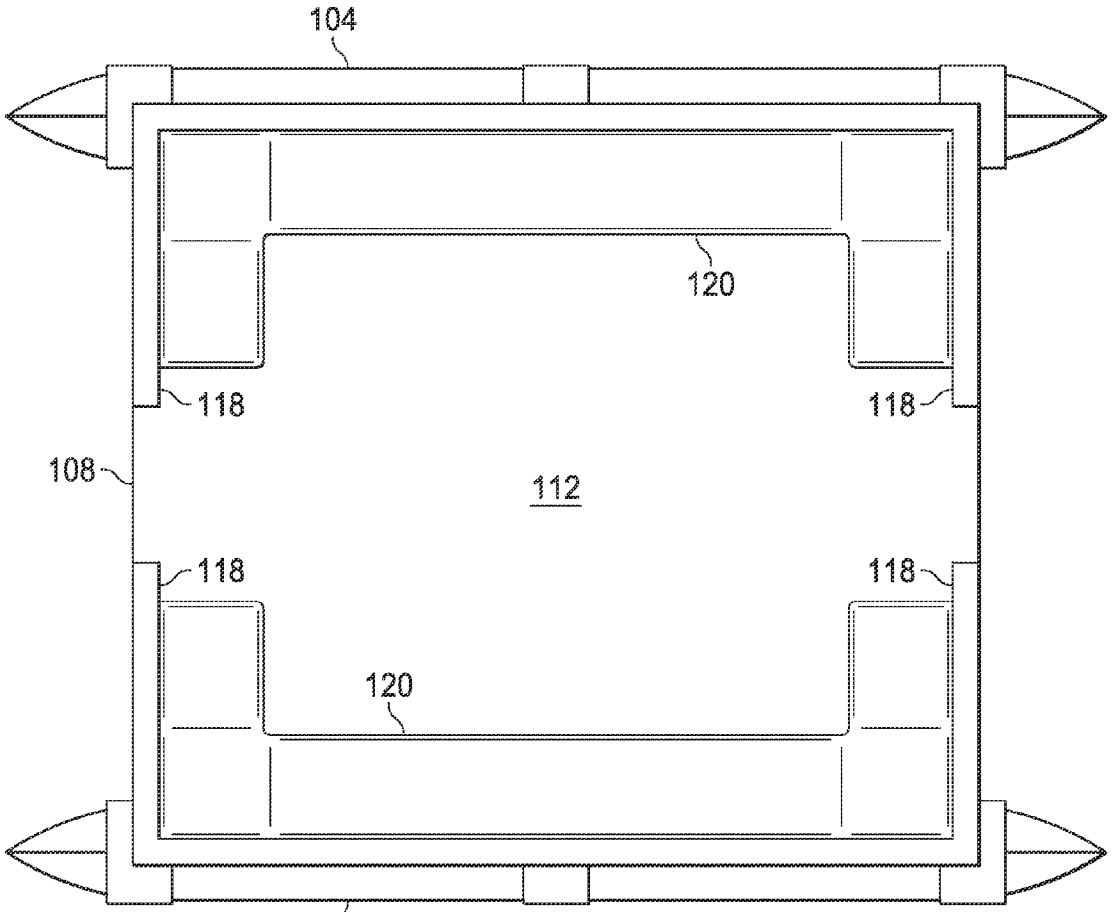
FIG. 7 is a top plan view of an embodiment of a modular pontoon-style boat showing inflatable seats coupled to the deck surface in accordance with this disclosure.

Referring now to FIG. 7, in some embodiments the boat 100 also includes one or more inflatable seats 120. The inflatable seats 120 are coupleable to the deck surface 112 by way of a removable coupling, such as, for example, a Velcro®-type coupling. The seats 120 may be made of any suitable, inflatable material and are deflateable to allow for storage in a compact configuration. While U-shaped seats 120 is shown in the embodiment illustrated in FIG. 7, the seats 120 can have any suitable shape in other embodiments.

For example, in some embodiments the seats 120 include one or more captain seats, forward facing seats, backward facing seats, and reclined, bed-type seats. In some embodiments, a user can remove one or more of the seats 120 from the deck surface 112 for use as a floatation device in the water.

Figure 8:
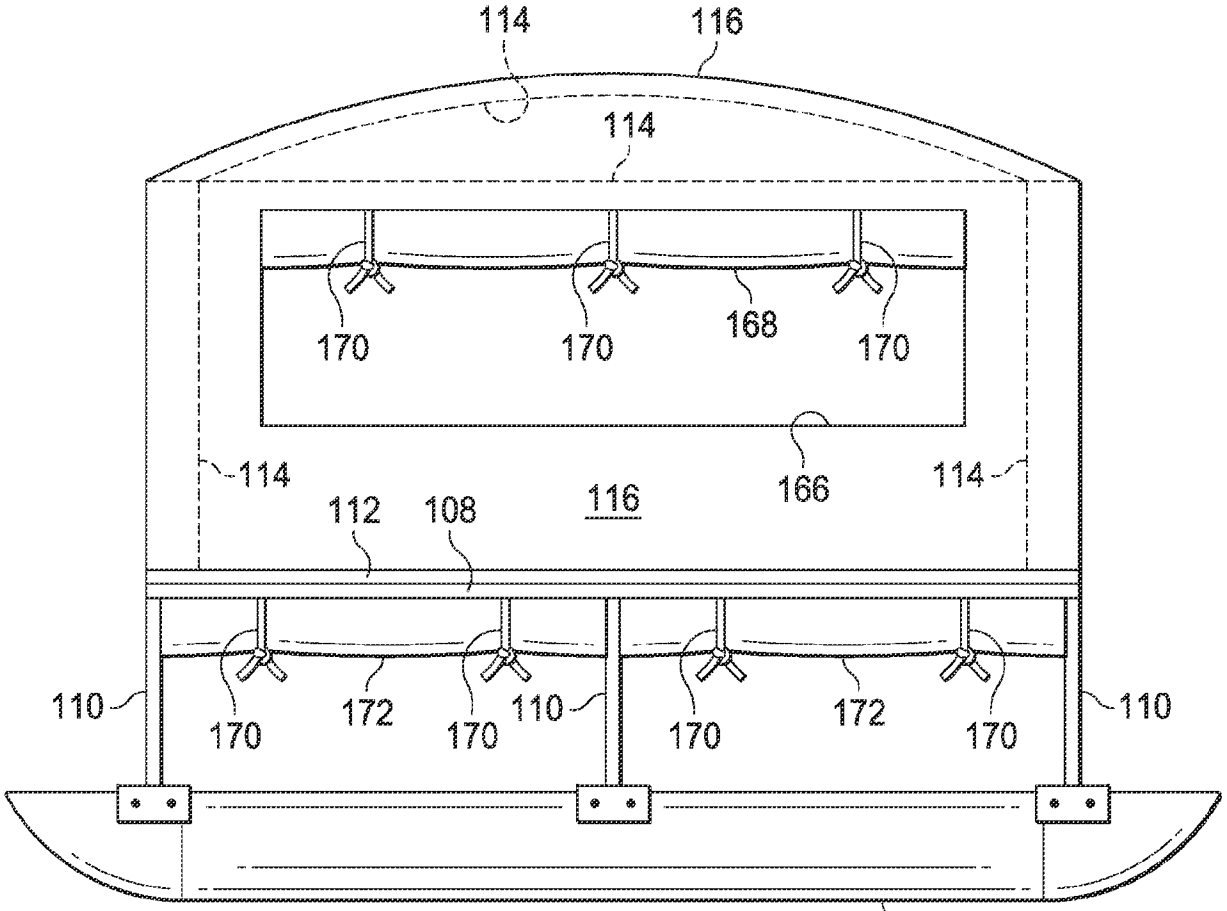
FIG. 8 is a side elevation view of an embodiment of a modular pontoon-style boat that includes a window and a window covering in accordance with this disclosure.

Referring now to FIGS. 1 and 8, in some embodiments the boat 100 includes an inflatable roof frame 114 that is removably coupleable to one or more of the deck surface 112 and the deck frame 108. The roof frame 114 extends vertically above the deck surface 112 and, in some embodiments, includes a front opening 162 (FIG. 1) and a back opening 164 (FIG. 1). In some embodiments, the front and back openings 162 and 164 allow a person to stand within the roof frame 114 and view in front of and behind the boat 100. In some embodiments, the roof frame 114 is inflatable and is made of a flexible material. Thus, in some embodiments, the roof frame 114 can be deflated for compact storage. In other embodiments, the roof frame 114 is rigid. While a rectangular roof frame 114 is shown in the embodiment illustrated in FIGS. 1 and 8, the roof frame 114 can be any suitable shape in other embodiments. In addition, other types of roofs can be removably coupled to the deck surface 112, such as, for example, an awning type roof.

In some embodiments, the roof frame 114 includes a roof material 116 that covers at least a portion of the roof frame 114. In some embodiments, for example, the roof material 116 covers an upper portion of the roof frame 114, as well as a portion of the sides of the roof frame 114. In some embodiments, the roof material 116 includes one or more window openings 166 and window coverings 168 adjacent to the window openings 116. In some embodiments, the window coverings 168 are made of a flexible material that can be retracted or rolled so that the window openings 116 are uncovered. For example, in some embodiments, the window coverings 168 are rollable and a user can tie the rolled window coverings with a suitable tying mechanism 170 to retain the window coverings 168 in the rolled position.

Referring specifically to FIG. 8, in some embodiments the boat 100 also includes coverings 172 positioned between the deck surface 112 and the pontoons 102 and 104. In some embodiments, the coverings 172 are flexible and can be stored by rolling and then securing the coverings 172 with securing mechanisms 170, as shown in FIG. 8.

Figure 9:
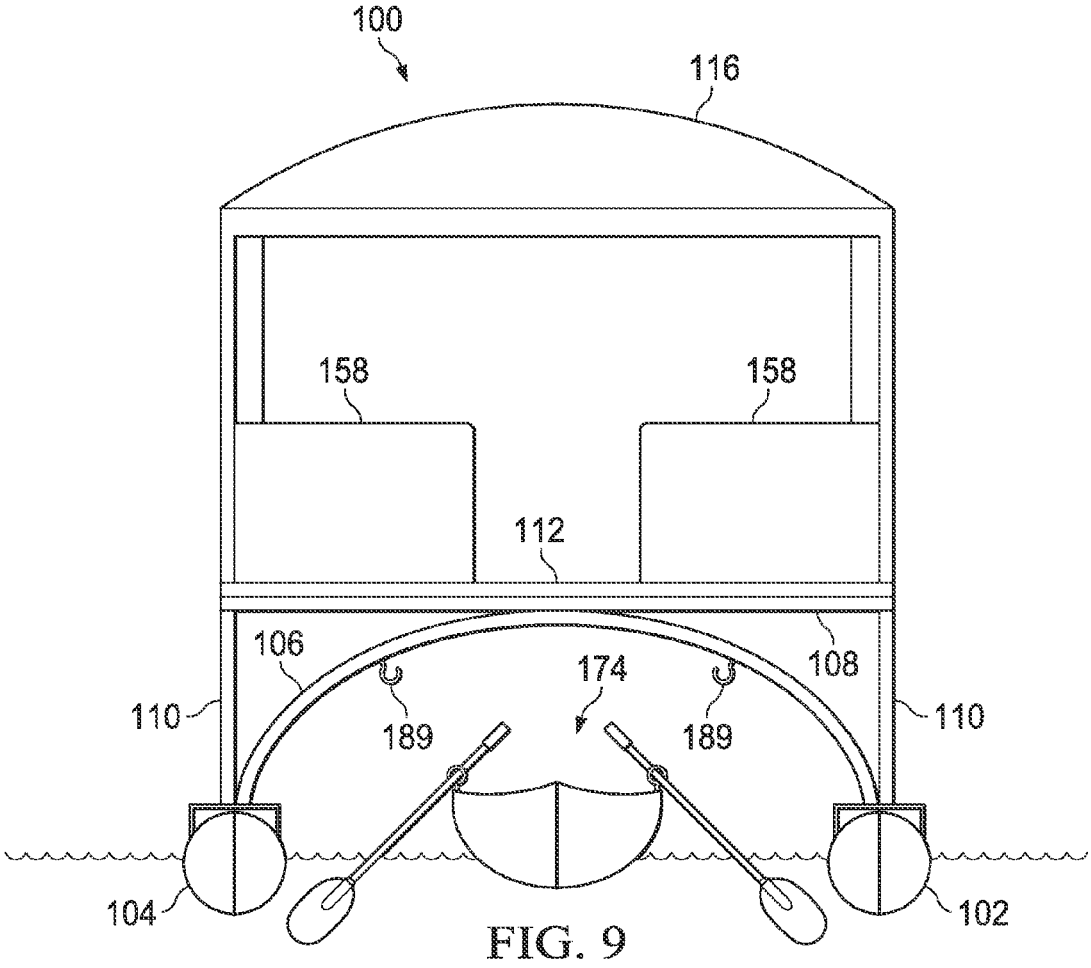
FIG. 9 is an end view of an embodiment of a modular pontoon-style boat with an additional watercraft positioned beneath the deck surface in accordance with this disclosure.

Referring now to FIG. 9, in some embodiments the arched coupling members 106 are of a sufficient height to allow for storage of an additional watercraft 174, or multiple watercraft 174, such as one or more kayaks, canoes, or an engine-powered watercraft, beneath the deck frame 108. In some embodiments, the arched support members 106, an underside of the deck surface 112 and/or the deck frame 108 include one or more hooks 189 or other securing devices to allow a user to hang objects underneath the deck surface. For example, in some embodiments, a user hangs a net from the hooks 189 to allow for storage of items on the net below the deck surface 112 and deck frame 108.

Figure 10A:
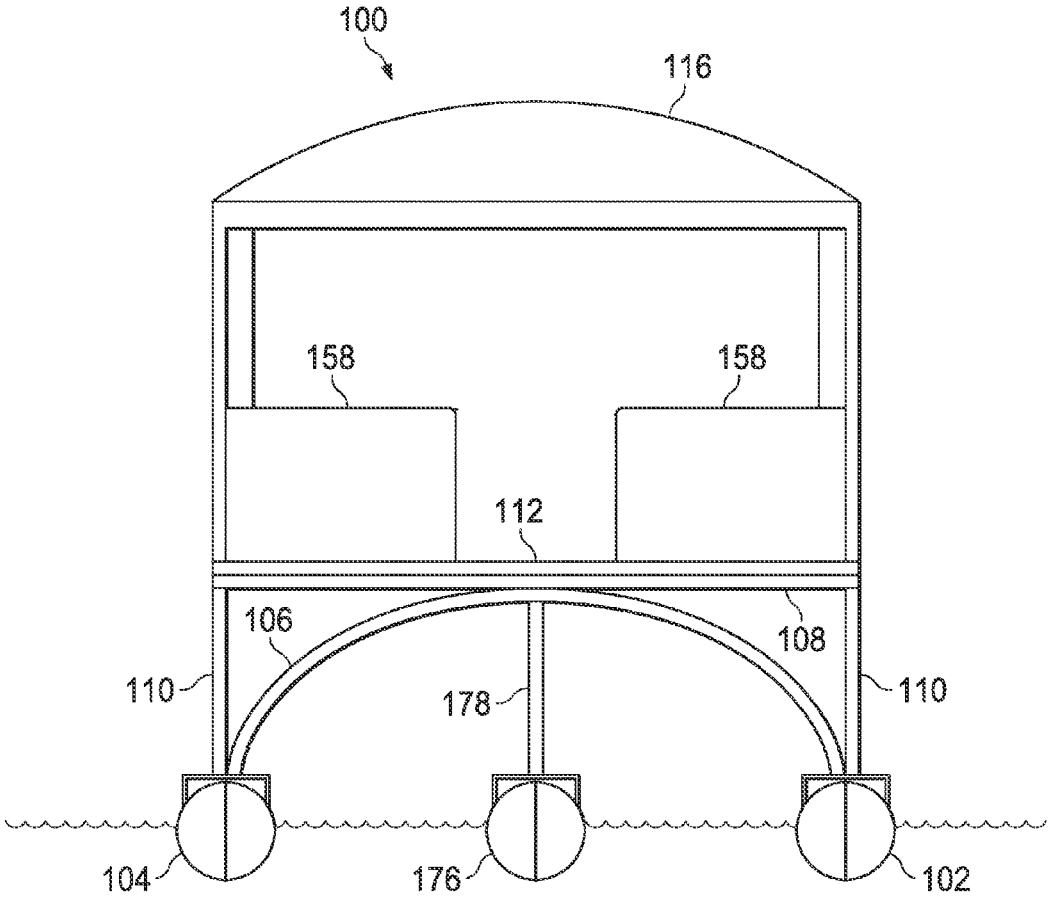
FIG. 10A is an end view of an embodiment of a modular pontoon-style boat that includes a third pontoon located between the first pontoon and the second pontoon in accordance with this disclosure.
Figure 10B:
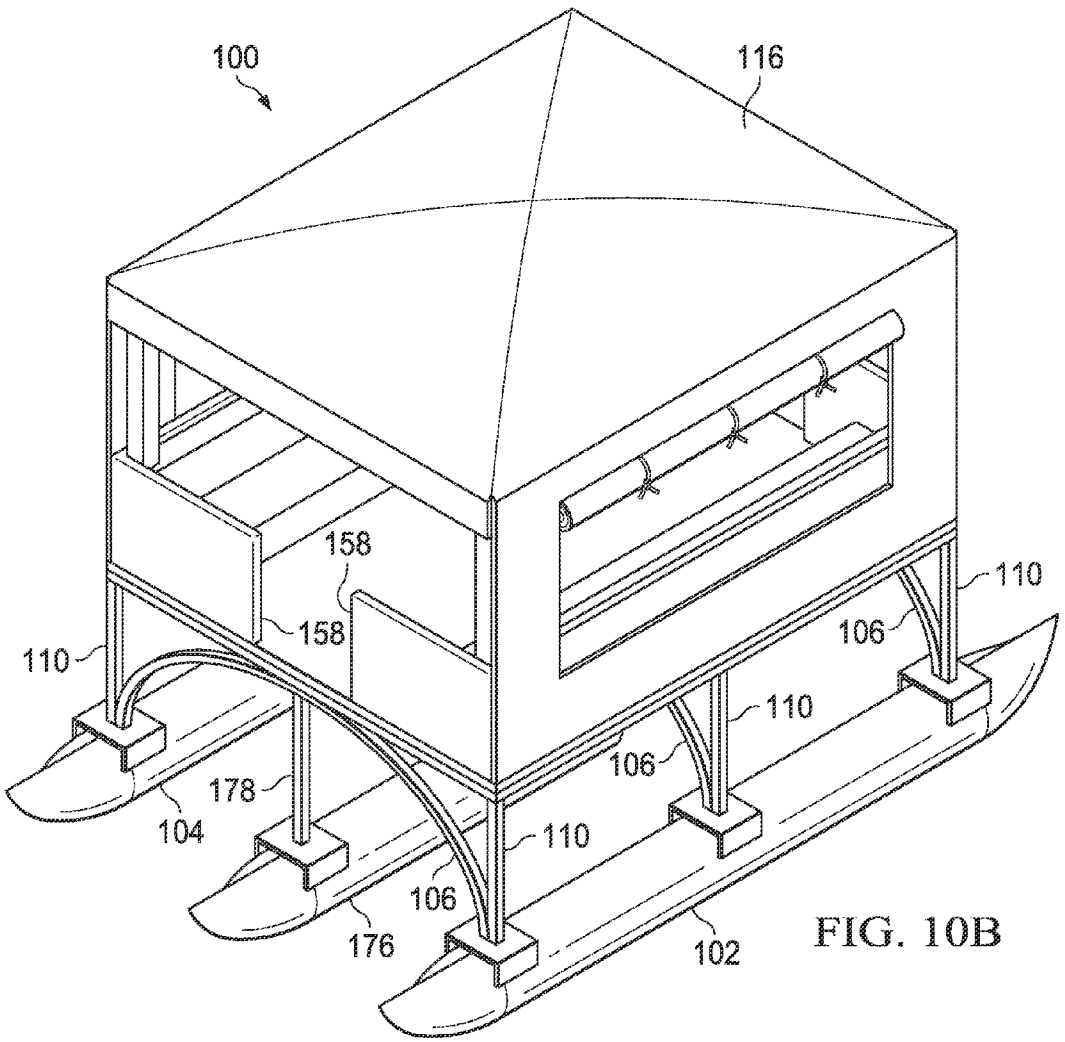
FIG. 10B is a perspective view of the modular pontoon-style boat of FIG. 10A.
Figure 11A:
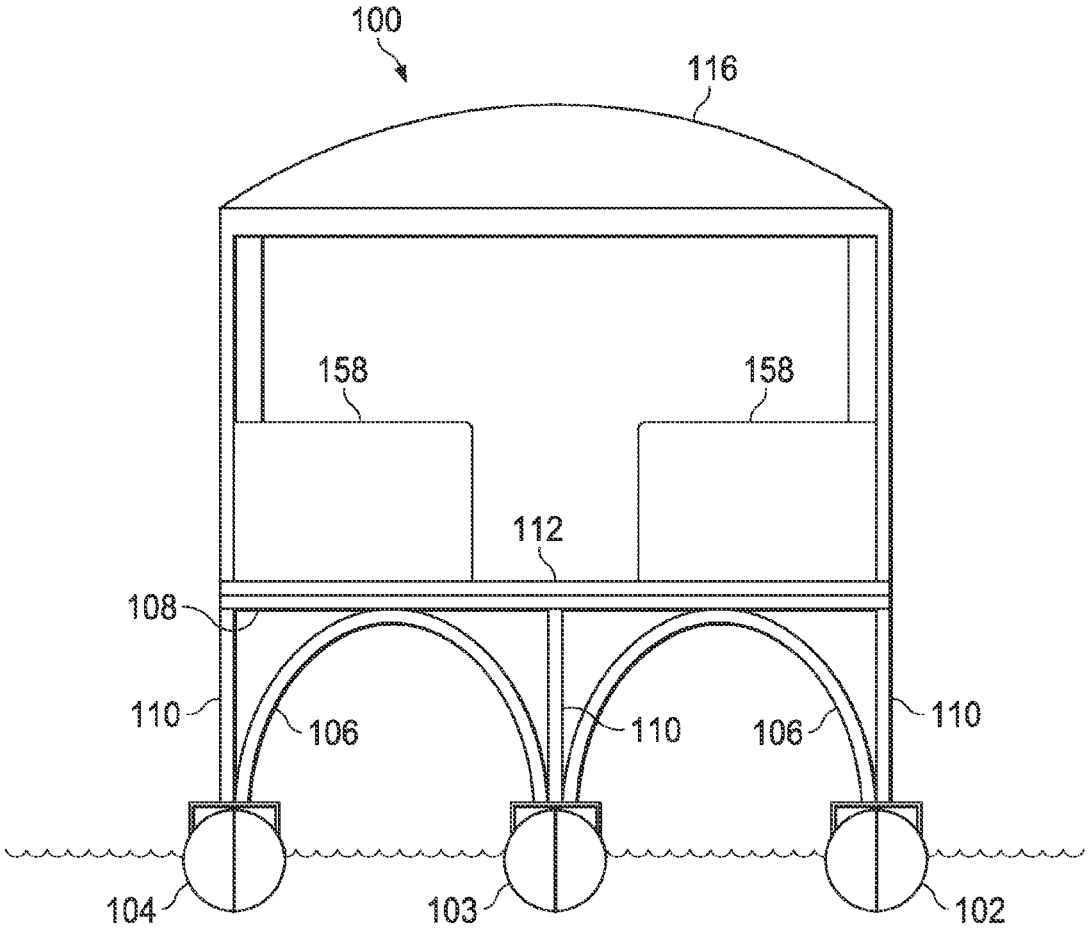
FIG. 11A is an end view of an embodiment of a modular pontoon-style boat that includes a central pontoon and at least two arched couplings in accordance with this disclosure.
Figure 11B:
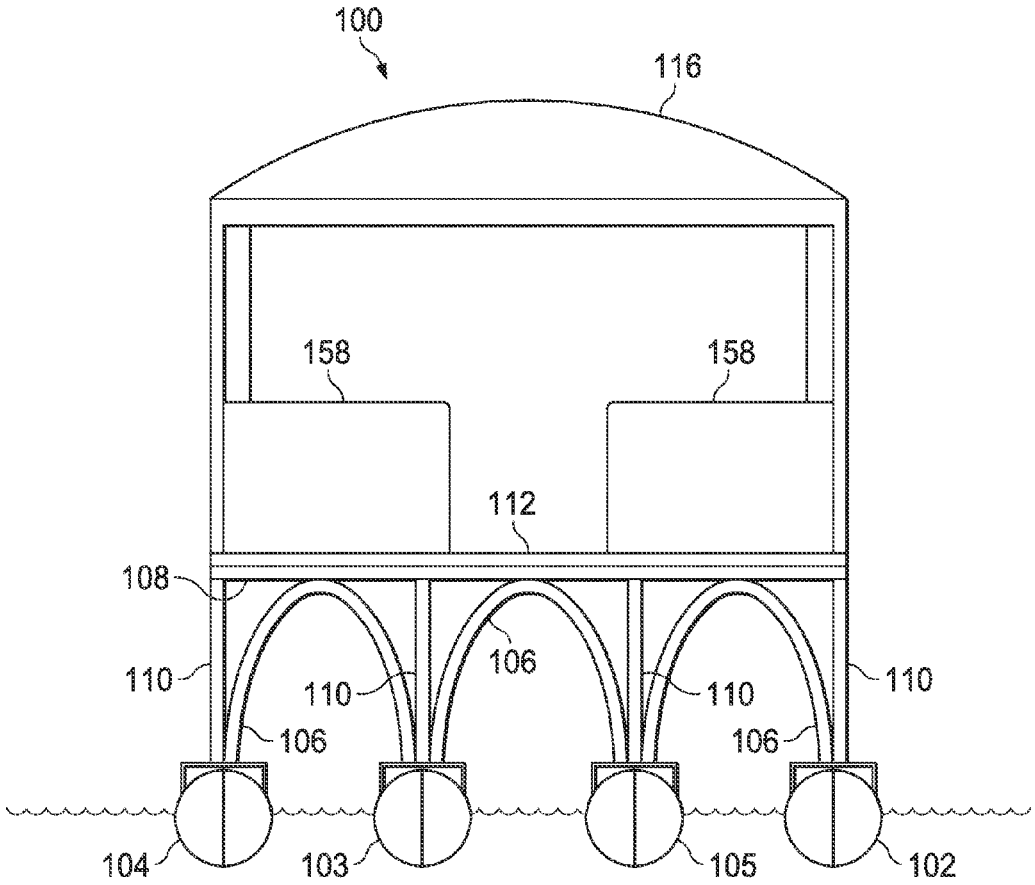
FIG. 11B is an end view of an embodiment of a modular pontoon-style boat that includes two central pontoons and at least three arched couplings in accordance with this disclosure.

Referring now to FIGS. 10A and 10B, in some embodiments the boat 100 includes a third pontoon 176 position between the first pontoon 102 the second pontoon 104. In some embodiments, the third pontoon 176 is coupled to the arched coupling member 106 by a vertical coupling member 178. In some embodiments, the third pontoon 176 is shorter than the first pontoon 102 in the second pontoon 104 and is positioned toward a front end of the boat 100 to counter balance the weight of a motor 134 positioned at a rear end of the boat 100. In some embodiments, the third pontoon 176 can be partially, or entirely, filed with water to counterbalance the weight of the motor 134.

In other embodiments, the boat 100 can include any number of full-sized pontoons 102, 104. For example, in the embodiment illustrated in FIG. 11A the boat 100 includes three pontoons 102, 103 and 104 and at least two arched coupling members 106 coupling the first outside pontoon 102 to the central pontoon 103 and the second outside pontoon 104 to the central pontoon 103. In the embodiment illustrated in FIG. 11B, the boat 100 includes four pontoons 102, 103, 104 and 105 and at least three arched coupling members 106 that couple adjacent pontoons 102, 103, 104 and 105. In other embodiments, the boat 100 can include any number of pontoons and a corresponding number of arched coupling members 106.

Figure 12A:
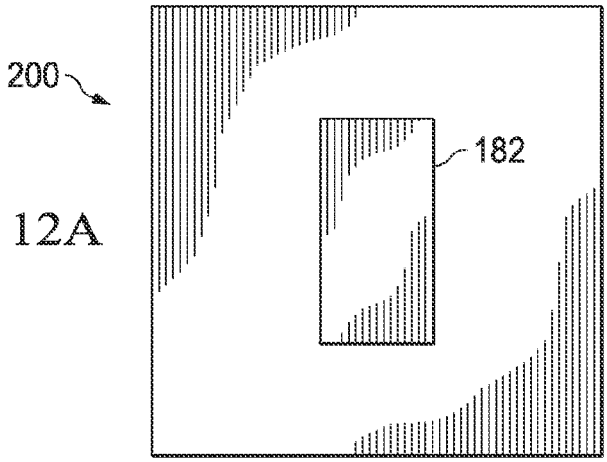
FIGS. 12 A-C illustrate embodiments of a peg and slot for use in coupling the components of a modular pontoon-style boat in accordance with this disclosure.
Figure 12B:
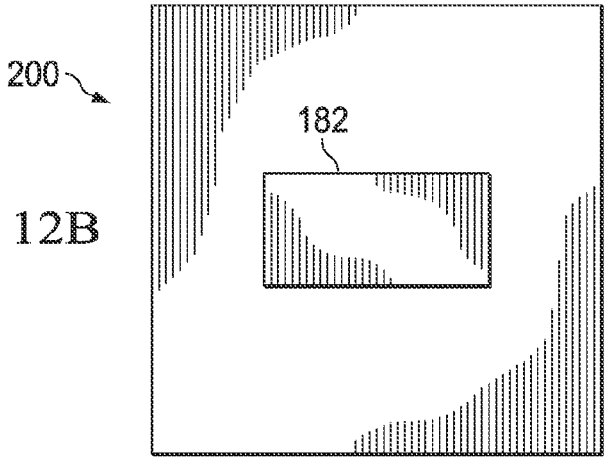
Figure 12C:
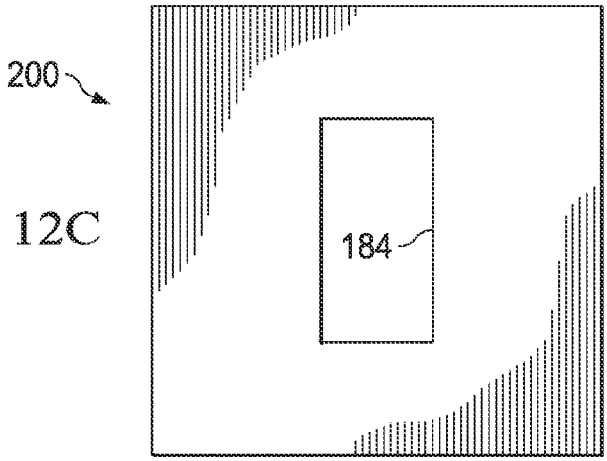

In some embodiments, at least some of the modular components of the boat 100 are coupled together using a peg system 200. For example, FIGS. 12A-12C illustrate a peg 182 that can be part of or coupled to a component of the boat 100 system, such as an inflatable seat 120, and a slot 184 that can be coupled to or part of another component of the boat 100, such as the deck surface, to allow a user to quickly and easily assemble and disassemble the components. The peg 182 is rotatable between a first position, as shown in FIG. 12A, and a second position that is perpendicular to the first position, as shown in FIG. 12B. In some embodiments, the open slot 184 (FIG. 12C) is sized and shaped to correspond to the peg 182 so that the peg 182 can be placed within the slot 184 and then turned ninety degrees so that the peg 182 is perpendicular to the slot 184, thereby locking the peg 182 in the slot 184 and locking the components coupled to the peg 182 and the slot 184 together. To disassemble to components, the user turns the peg 182 from the perpendicular position with respect to the slot 184 to the aligned position with respect to the slot 184 and the user moves the components away from each other. In some embodiments, the deck frame 108, the deck material 112 and the roof frame 114 include equally spaced slots 184 so that the other components can be easily coupled to the deck frame 108, the deck surface 112 and the roof frame 114, in a modular, customizable fashion. In some embodiments, the slots 184 are placed at various locations on the deck frame 108, the deck surface 112 and the roof frame 114 to allow for customized location of corresponding components.

Figure 13:
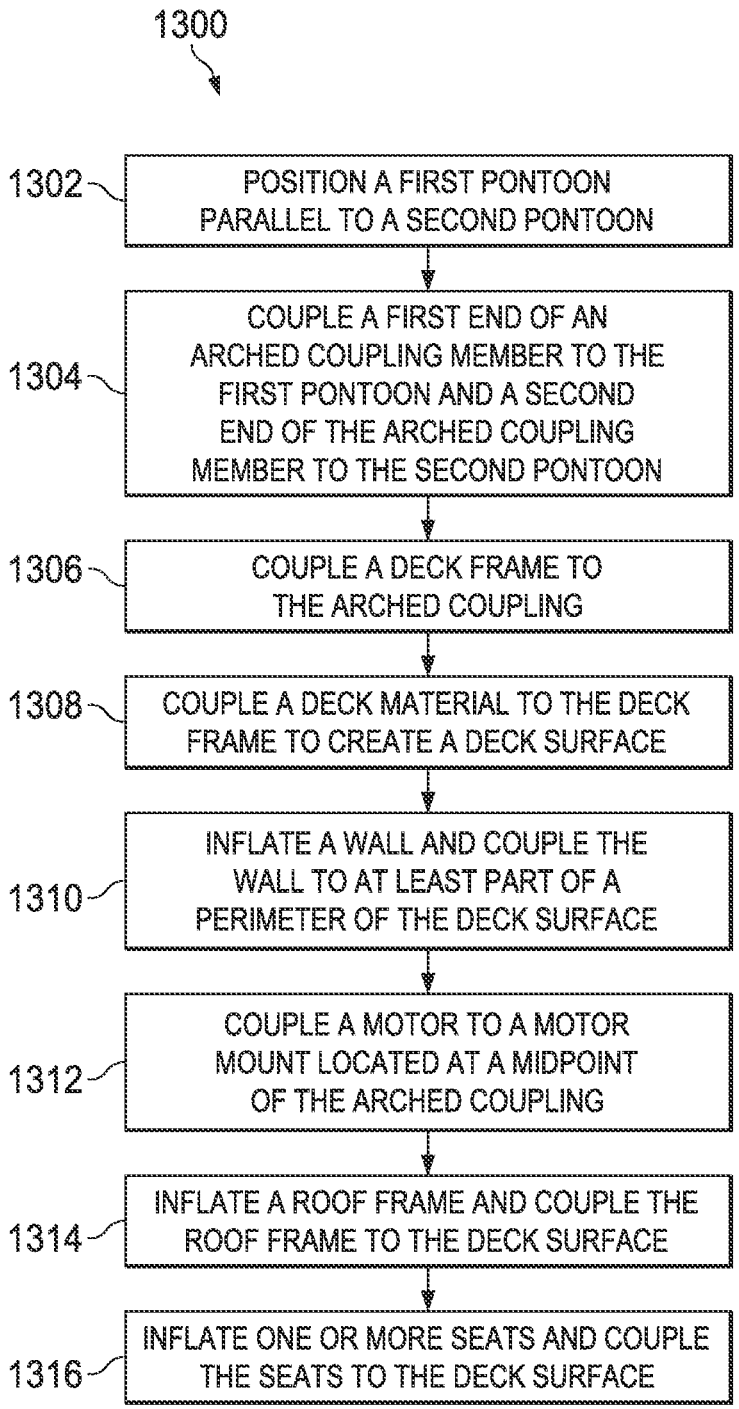
FIG. 13 is a schematic block diagram illustrating a method of assembling a modular pontoon-style boat in accordance with this disclosure.

Referring now to FIG. 13, an embodiment of a method 1300 of assembling a modular, partially-inflatable boat 100 is shown. In some embodiments, the method 1300 begins and the first pontoon 102 is positioned so that it is parallel to the second pontoon 104, as shown at block 1302. A user then couples a first end 128 of an arched coupling member 106 to the first pontoon 102 and a second end 130 of the arched coupling member 106 to the second pontoon 104, as shown at block 1304. The user then couples a deck frame 108 to the arched coupling member 106, as shown at block 1306, and couples a deck material to the deck frame 108 to create a deck surface 112, as shown at block 1308. The user then inflates a wall 118 and couples the wall 118 to at least part of a perimeter of the deck surface, as shown at block 1310. In some embodiments, the user also couples a motor 134 to a motor 134 mount 132 located at a midpoint of the arched coupling, as shown at block 1312. In other embodiments, the user also couples a roof frame 114 to the deck surface 112, as shown at block 1314. In some embodiments, the user also inflates one or more seats 120 and couples the seats 120 to the deck surface 112, as shown at block 1316.

In use, a user transports the boat 100 in the disassembled state to a body of water. The user then assembles the boat 100 at or near the body of water and then pushes the boat 100 into the water. In some embodiments, the assembled boat 100 is sufficiently light to be pushed/pulled by one or more people. In other embodiments, the assembled boat 100 is moved into and out of the water with the assistance of a pulling mechanisms, such as a mechanical winch.

When the user has finished using the boat 100, the boat 100 can be removed from the body of water by pulling the boat 100 onto the shoreline. Once the boat 100 has been removed from the body of water, the user can completely or partially disassemble the boat 100 for compact storage. For example, in some embodiments the inflatable components of the boat 100, such as the seats 120 and the roof frame 114 in some embodiments, are deflated and the boat 100 is stored. In other embodiments, the inflatable components of the boat 100 are deflated and the other components of the boat 100, such as the deck frame 108 in some embodiments, are disassembled so that the components of the boat 100 can be stored more compactly.

Figure 14:
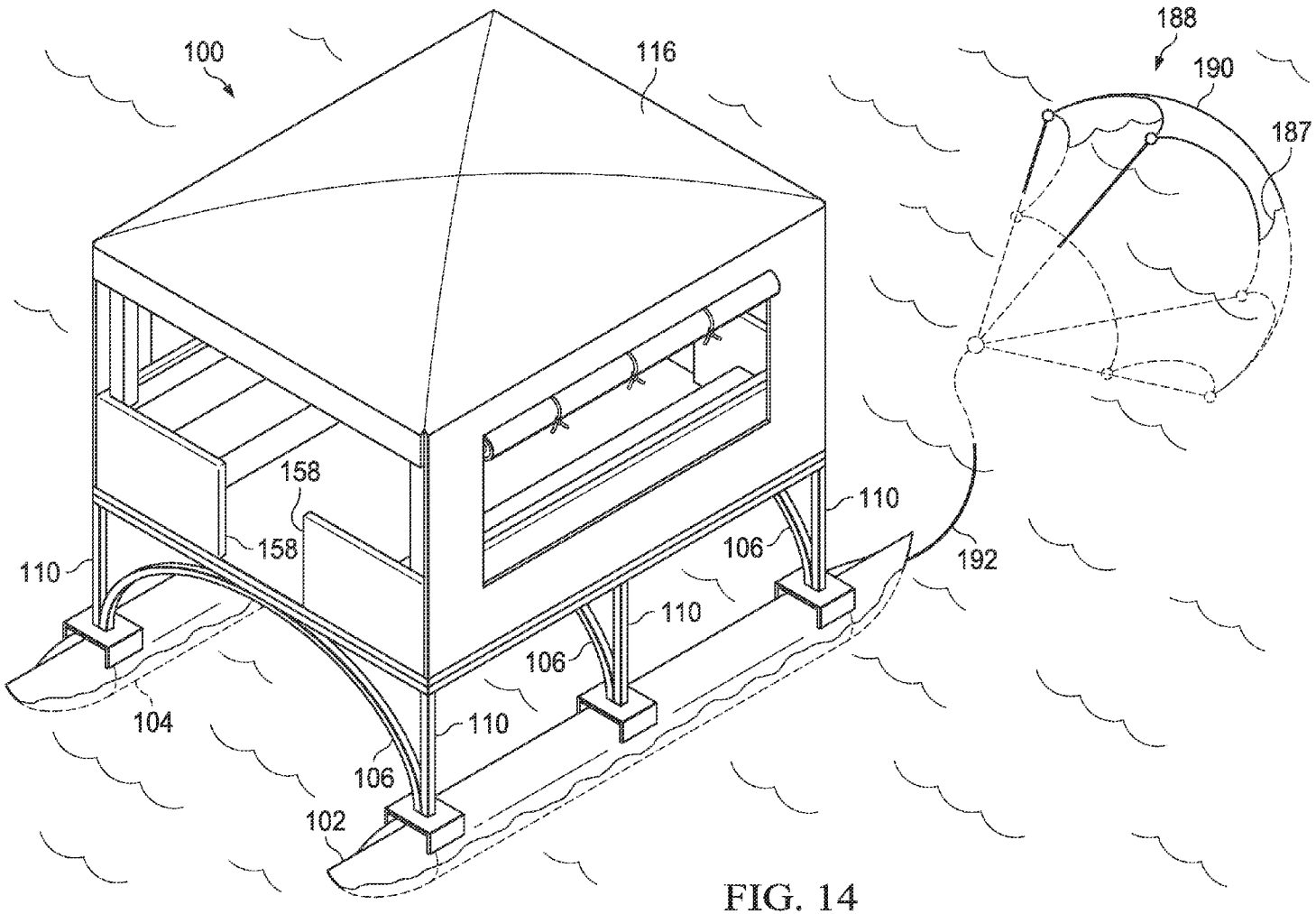
FIG. 14 is a perspective view of another embodiment of a modular pontoon-style boat that includes a drift net in accordance with this disclosure.

Referring now to FIG. 14, in some embodiments the boat 100 includes a drift net 188 that is coupleable to one or more of the pontoons 102 and 104. In some embodiments, the drift net 188 includes a net 190 and a line 192 that couples the net 190 to the pontoon 102 or 104. In use, the net 190 is at least partially submerged under the water level 187 to help maintain the boat 100 in a desired location. In some embodiments, the drift net 186 helps to counteract boat movement that may be caused by water current and/or wind. In some embodiments, the drift net 188 also provides a stabilizing force to the boat 100 to help prevent the boat from tipping over due to high winds.

Figure 15A:
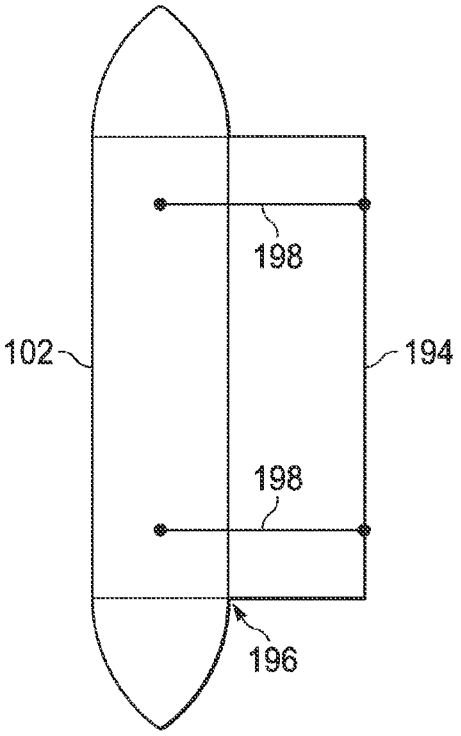
FIG. 15A is a top view of an embodiment of a pontoon with a drift plate in the extended position in accordance with this disclosure.
Figure 15B:
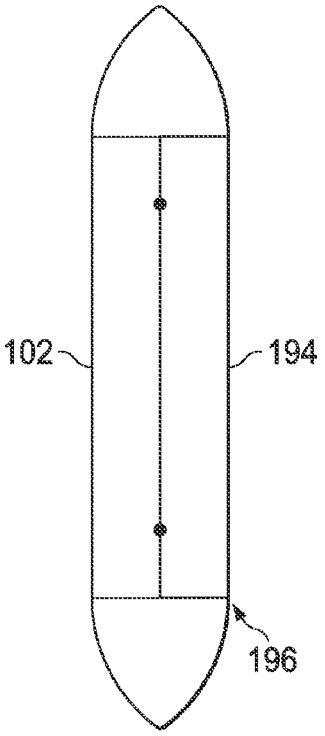
FIG. 15B is a top view of an embodiment of a pontoon with a drift plate in the refracted position in accordance with this disclosure.

Referring now to FIGS. 15A and 15B, in some embodiments one or more of the pontoons 102 and 104 (only pontoon 102 is shown in FIGS. 15A and 15B for clarity) includes a retractable drift plate 194 that is movably coupleable to the pontoon 102 or 104. In some embodiments, the drift plate 194 is coupled to the pontoon 102 or 104 at a hinge 196 to allow a user to move the drift plate 194 between an extended position (FIG. 15A) and a retracted position (FIG. 15B). One or more lines 198 maintain the position of the drift plate 194 when the drift plate 194 is in the extended position. In some embodiments, both the first pontoon 102 and the second pontoon 104 include one or more drift plates 194. In some embodiments, the drift plates 194 of the pontoons 102 and 104 are submerged in the water when in the extended position to helps to steady the boat 100 in high wind situations. In some embodiments, the drift plates 194 conform to the outer shape of the pontoons 102 and 104 so that the drift plates 194 can be storage against the pontoons 102 and 104 when in the retracted position, as shown in FIG. 15B.

Figure 16A:
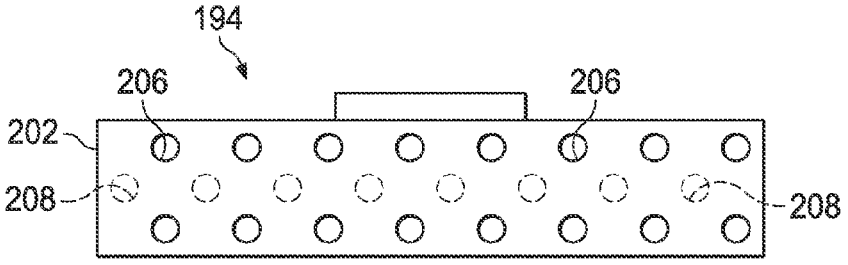
FIG. 16A is a top view of an embodiment of a multi-piece drift plate in the retracted position in accordance with this disclosure.
Figure 16B:
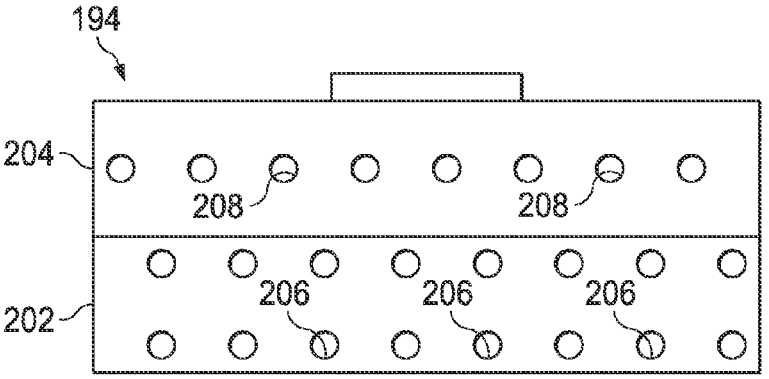
FIG. 16B is a top view of an embodiment of a multi-piece drift plate in the extended position in accordance with this disclosure.

Referring now to FIGS. 16A and 16B, in some embodiments the drift plate 194 includes a first plate 202 that is movably coupled to a second plate 204. The first and second plates 202 and 204 include openings 206 and 208, respectively, that are mis-aligned when the first and second plates 202 and 204 are placed side-by-side in the retracted position, as shown in FIG. 16A. In the retracted position, the drift plate 194 can be placed in the water so that the water cannot easily move through the openings 206 and 208. When a user desires to remove the drift plate 194 from the water, the user moves the first plate 202 (or the second plate 204) so that the openings 206 and 208 of the plates 202 and 204 are uncovered and so that the plates 202 and 204 are aligned one above the other, as shown in FIG. 16B. As such, water moves easily through the uncovered openings 206 and 208 and the drift plates 194 are more easily removed from the water. In some embodiments, the user pulls upward on one of the plates 202 or 204 to transition the plates 202 and 204 between the side-by-side position (i.e., the retracted position shown in FIG. 16A) and the aligned position (i.e., the extended position shown in FIG. 16B).

The foregoing describes only some embodiments of the invention(s), and alterations, modifications, additions and/or changes can be made thereto without departing from the scope and spirit of the disclosed embodiments, the embodiments being illustrative and not restrictive. For example, in other embodiments, other types of coupling mechanisms are used to removably couple the components of the boat 100. For example, in some embodiments, the components are coupled using bolts and nuts rather than, or in addition to, the peg 182 and slot 184 configuration described above. In addition, while certain components have been described as being inflatable, such as the seats 120, the wall 118 and the roof frame 114, in other embodiments those parts are made of rigid materials such as aluminum or hard plastic materials. Similarly, components that have been described as being rigid, such as the deck frame 108, are inflatable in some embodiments. In some embodiments, the components of the boat 100, such as the pontoons 102 and 104, the arched coupling members 106, the vertical support members 110, the deck frame 108, the deck surface 112, the roof frame 114 and the roof material 116, are made of lightweight materials so that the boat 100 weighs between about 875 lbs. and about 1250 lbs. pounds when fully assembled. In other embodiments, the boat 100 weighs between about 675 lbs. and about 2500 lbs. In other embodiments, the boat 100 weights less than about 675 lbs. while in other embodiments the boat 100 weights more than about 2500 lbs. In some embodiments, the components of the boat 100, when disassembled, fit within a bed of a pickup truck. For example, in some embodiments, the components of the boat 100 fit within a four foot by eight foot bed of a pickup truck. In some embodiments, the deck material 112 is made of a trampoline material and the deck is spring loaded. In some embodiments, the inflatable components are inflated using a hand pump or an electronic air pump. In some embodiments, the shape of the roof frame 114 is customized to resemble the shape of an object, such as, by way of non-limiting example, a pirate ship, a car, a tractor, a train, or a castle. In some embodiments, additional features, such as inflatable slides, can be coupled to the roof frame 114 or other parts of the boat 100. In some embodiments, the inflatable seats 120 have a hollow cavity to house items. In some embodiments, for example, the hollow cavities in the seats 120 act as coolers for holding drinks and food. In some embodiments, inflatable bumpers are coupleable to the components that are made of hard materials, such as the deck frame 108 in some embodiments, to protect users of the boat 100.

In the foregoing description of certain embodiments, specific terminology has been resorted to for the sake of clarity. However, the disclosure is not intended to be limited to the specific terms so selected, and it is to be understood that each specific term includes other technical equivalents which operate in a similar manner to accomplish a similar technical purpose. Terms such as "left" and right", "front" and "rear", "above" and "below" and the like are used as words of convenience to provide reference points and are not to be construed as limiting terms.

In this specification, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

Furthermore, invention(s) have been described in connection with what are presently considered to be the most practical and preferred embodiments and it is to be understood that the invention is not to be limited to the disclosed embodiments, but on the contrary, is intended to cover various modifications and equivalent arrangements included within the spirit and scope of the invention(s). Also, the various embodiments described above may be implemented in conjunction with other embodiments, e.g., aspects of one embodiment may be combined with aspects of another embodiment to realize yet other embodiments. Further, each independent feature or component of any given assembly may constitute an additional embodiment.

What is claimed is:

1. A modular boat, comprising:

a first pontoon and a second pontoon;

an arched coupling member that is removably coupleable to the first pontoon and the second pontoon and having an arch portion spanning from the first pontoon to the second pontoon;

a deck frame that is removably coupleable to the arched coupling member;

a deck surface that is removably coupleable to the deck frame, the deck surface having a perimeter defined in part by a first side and a second side disposed opposite the first side, the first pontoon supporting the first side of the deck surface and the second pontoon supporting the second side of the deck surface in an elevated position; and at least one inflatable seat that is removably coupleable to the deck surface.

2. The modular boat of claim 1, wherein the arched coupling member comprises a width between a first end and a second end of the arched coupling member, and wherein the arched coupling member comprises a height between an apex of the arched coupling member and the first and second ends of the arched coupling member, wherein the apex is disposed midway between the first and second pontoons.

3. The modular boat of claim 1, wherein the arched coupling member comprises a motor mount at a midpoint of the arched coupling member.

4. The modular boat of claim 3, wherein the motor mount extends from the midpoint toward a water surface when the boat is on a body of water.

5. The modular boat of claim 1, further comprising a first vertical support member and a second vertical support member, wherein the first vertical support member is removably coupleable to the first pontoon and the deck frame and wherein the second vertical support member is removably coupleable to the second pontoon and the deck frame.

6. The modular boat of claim 1, further comprising an inflatable roof frame removably coupleable to one or more of the deck frame and the deck surface.

7. The modular boat of claim 6, further comprising a flexible roof material removably coupleable to the inflatable roof frame, wherein the roof material comprises one or more retractable window coverings.

8. The modular boat of claim 1, wherein the deck surface comprises a plurality of rigid, interlocking deck pieces.

9. A pontoon boat, comprising:

a deck frame;

a deck surface supported by the deck frame and having a perimeter defined in part by a first side and a second side disposed opposite the first side;

a first pontoon supporting the first side of the deck surface;

a second pontoon disposed spaced apart from the first pontoon and supporting the second side of the deck surface; and a plurality of arched coupling members coupled to the first and second pontoons, an arch portion of each arched coupling member spanning from the first pontoon to the second pontoon, each of the arched coupling members supporting the deck surface in an elevated position.

10. The pontoon boat of claim 9, further comprising a first steering rudder coupled to a back end of the first pontoon and a second steering rudder coupled to a back end of the second pontoon.

11. The pontoon boat of claim 10, further comprising a steering cable operably coupled between a steering device and the first and second steering rudders.

12. The pontoon boat of claim 9, further comprising a third pontoon positioned between the first and second pontoons, wherein the third pontoon is shorter than the first and second pontoons.

13. The pontoon boat of claim 9, further comprising an inflatable seat coupled to the deck surface.

14. The pontoon boat of claim 9 wherein the deck surface is elevated a distance above a water surface on which the first and second pontoons float.

15. The pontoon boat of claim 14 wherein the distance is in a range of three to eight feet.

16. The pontoon boat of claim 15 wherein the distance is five feet.

17. The pontoon boat of claim 9 wherein the second pontoon is spaced apart from the first pontoon a distance in a range of six to eighteen feet.

18. The pontoon boat of claim 17 wherein the distance is ten feet.

19. The pontoon boat of claim 9 wherein an apex of each of the arched portions is disposed midway between the first and second pontoons.

20. The pontoon boat of claim 9 wherein the deck surface is rectangular-shaped.

* * * * *